US007148810B2

(12) United States Patent
Bhat

(10) Patent No.: US 7,148,810 B2
(45) Date of Patent: Dec. 12, 2006

(54) EVACUATION SYSTEMS PROVIDING ENHANCED OPERATIONAL CONTROL

(75) Inventor: Ishwara A. Bhat, Bangalore (IN)

(73) Assignee: Honeywell International, Inc., Morristown, NJ (US)

( * ) Notice: Subject to any disclaimer, the term of this patent is extended or adjusted under 35 U.S.C. 154(b) by 126 days.

(21) Appl. No.: 10/708,899

(22) Filed: Mar. 30, 2004

(65) Prior Publication Data

US 2005/0231349 A1 Oct. 20, 2005

(51) Int. Cl.
*G08B 25/08* (2006.01)

(52) U.S. Cl. ..... 340/692; 340/691.1; 340/286.01; 340/286.11; 340/825.24; 381/82

(58) Field of Classification Search ..... 340/692, 340/517, 531, 691.1, 506, 628, 286.05, 286.01, 340/286.11, 3.1, 3.2, 3.52, 825.22, 825.24, 340/825.25; 381/82
See application file for complete search history.

(56) References Cited

U.S. PATENT DOCUMENTS

| | | | | |
|---|---|---|---|---|
| 4,531,114 | A * | 7/1985 | Topol et al. | 340/539.1 |
| 4,796,018 | A * | 1/1989 | Nakanishi et al. | 340/691.1 |
| 5,705,979 | A * | 1/1998 | Fierro et al. | 340/517 |
| 6,097,289 | A * | 8/2000 | Li et al. | 340/531 |
| 6,167,255 | A * | 12/2000 | Kennedy et al. | 455/414.1 |
| 6,175,307 | B1 * | 1/2001 | Peterson | 340/531 |
| 6,232,888 | B1 * | 5/2001 | Davis et al. | 340/905 |
| 6,323,780 | B1 * | 11/2001 | Morris | 340/692 |
| 6,348,860 | B1 * | 2/2002 | Davis et al. | 340/525 |
| 6,426,697 | B1 * | 7/2002 | Capowski et al. | 340/506 |
| 6,624,750 | B1 * | 9/2003 | Marman et al. | 340/506 |
| 6,693,532 | B1 * | 2/2004 | Capowski et al. | 340/506 |
| 6,784,798 | B1 * | 8/2004 | Morris | 340/628 |
| 6,856,258 | B1 * | 2/2005 | Kirschner et al. | 340/994 |
| 6,897,772 | B1 * | 5/2005 | Scheffler et al. | 340/506 |
| 2002/0147982 | A1 | 10/2002 | Naidoo et al. | |
| 2003/0054798 | A1 | 3/2003 | Kobayashi | |
| 2003/0061344 | A1 | 3/2003 | Monroe | |
| 2003/0062997 | A1 | 4/2003 | Naidoo et al. | |
| 2003/0139134 | A1 | 7/2003 | Bailey et al. | |

FOREIGN PATENT DOCUMENTS

| | | | |
|---|---|---|---|
| EP | 1293908 | A1 | 3/2003 |
| WO | WO 03/026305 | A1 | 3/2003 |

* cited by examiner

*Primary Examiner*—Davetta W. Goins
(74) *Attorney, Agent, or Firm*—Narendra Reddy Thappeta

(57) ABSTRACT

An evacuation system, which provides enhanced operational control to an operator. In an embodiment, each voice point module capable of playing evacuation messages is implemented as an addressable unit, and an operator can cause different messages to be played on different voice point modules using a central station. The central station enables the operator to play live messages by capturing the voice of the operator and forwarding the voice in the form of voice data. Protocols such as H.323 may be supported on both voice point modules and the central station such that control data can be sent from the central station to the voice point modules. The control data can be used as a basis to provide features such as changing the volume level, storing messages locally in the voice point modules, specifying specific stored message to be played, etc.

25 Claims, 6 Drawing Sheets

EVACUATION SYSTEMS PROVIDING ENHANCED OPERATIONAL CONTROL

BACKGROUND OF INVENTION

1. Field of the Invention

The present invention generally relates to evacuation systems, and more specifically to a method and apparatus, which provides enhanced operational control in using such systems.

2. Related Art

Evacuation systems are generally used to detect undesirable situations such as fire hazards, and to perform actions such as generating evacuation messages (e.g., voice/audio messages or sounds) when an undesirable situation is detected or suspected. Thus, evacuation systems typically contain detectors to detect a hazardous situation and voice generators to generate the messages if/when a detector indicates the occurrence of the hazardous situation.

The messages may facilitate, for example, evacuation of people from a large building or manufacturing plant as is well known in the relevant arts. There is a general need to provide enhanced operational control in the use of evacuation systems. That is, the systems generally need to provide features, which give more operational control to deal with specific hazardous situations.

SUMMARY OF INVENTION

An evacuation system provided according to an aspect of the present invention includes individually addressable voice point modules, and a central station. The central station may be designed to receive alarms (from detectors which detect undesirable situations) and to cause a potentially different message to be played on each of the voice point modules. As a result, an operator using the station may have enhanced control over evacuation procedures.

The evacuation system may further contain a fire alarm control panel (FACP) positioned between the central station and the detectors, with the FACP receiving alarms from the detectors and forwarding the alarms to the central station. The FACP may send packets (containing the alarms) directly to the multiple voice point modules without the FACP being in the path from the station to the multiple detectors. As a result, the alarms may be delivered reliably to the central station.

In an embodiment, the central station and voice point modules are connected by a network, wherein each of the multiple voice modules is individually addressable by an addressing approach specified by the network. Protocols such as Internet Protocol (IP) may be used associated with the network.

According to another aspect of the present invention, a central station enables an operator to speak and provide corresponding voice as a live message on one or more of the voice point modules. The central station may convert the live message as a voice data and forwards the voice data to the voice point modules. To enable such features, the central station may be designed to send control data to each of the multiple voice point modules on a control connection. The control data and voice data may be sent according to protocols such as H.323 protocol.

The control data may be used to store custom voice messages on individual voice point modules, for potentially selectively playing later. Control data may accordingly specify that associated voice data is to be stored locally in a voice point module. As a result, a central station may be designed to store many messages, and store only desired messages selectively in each voice point module. Thus, voice point modules can be implemented with small memory storage, while having the flexibility of using any of many messages stored in the central station.

The control data can be used to provide other features as well. For example, the control data may specify that the volume level at a voice point module is to be changed (increased or decreased), and the volume of the speaker may accordingly be adjusted. Such a feature may be useful to adjust the voice levels as suited for the acoustics of individual locations. The control data can be used to setup telephone calls (either point to point or teleconference) with multiple voice point modules and the central station.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the left-most digit(s) in the corresponding reference number.

BRIEF DESCRIPTION OF DRAWINGS

The present invention will be described with reference to the accompanying drawings, which are described briefly below.

DETAILED DESCRIPTION

1. Overview

An aspect of the present invention provides voice point modules (which can play audio messages), which are individually accessible from a central station using a network (e.g., a local area network implemented using Internet Protocol). Due to such accessibility, the central station may be used to generate custom voice messages at each voice point module, which are specific, for example, to the undesirable/hazardous situation detected and the location of the voice generator. As a result, a user of the evacuation system may have enhanced operational control during evacuations.

According to another aspect of the present invention, each message may either be a pre-stored message or a live message (i.e., whatever the operator speaks may be immediately played at the voice point modules). As a result, an operator may be provided enhanced control over any evacuation procedures.

According to yet another aspect of the present invention, a central station can send control data to voice point modules. The control messages can form the basis for various features such as changing the volume of the messages played by the voice point modules, storing messages at voice point modules, causing a desired one of the pre-stored messages to be played at the voice point modules, etc.

Several aspects of the present invention will be clear by understanding the operation of some conventional systems, which do not implement one or more features of the present invention. Accordingly, some such example conventional systems are described below first.

2. Conventional Systems

Figure 1:
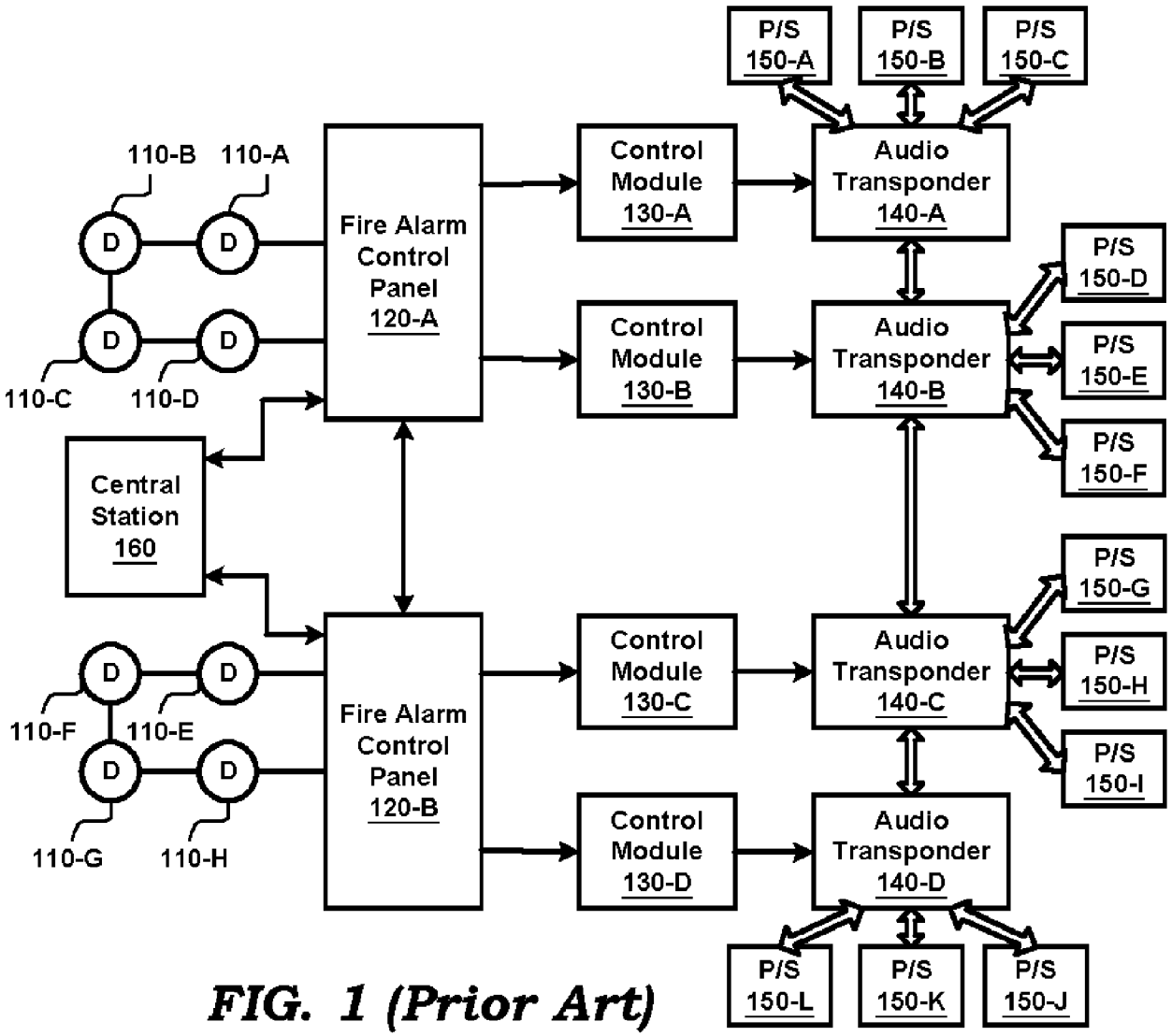
FIG. 1 (Prior Art)
FIG. 1 is a block diagram illustrating some example limitations of a conventional evacuation system.

FIG. 1 is a block diagram illustrating some example limitations with a conventional evacuation system. The evacuation system is shown containing detectors 110-A through 110-H, fire alarm control panels (FACP) 120-A and 120-B, control modules 130-A, through 130-D, audio transponders 140-A through 140-D, phone/speaker units 150-A through 150-L and central station 160. Each component is described below in detail.

Though not illustrated in FIG. 1, broadly, detectors are placed in different locations where it is desirable to detect a hazardous activity. Phone/speaker units are placed in locations where it would be desirable to play the voice warning messages or instructions. Control modules and audio transponders may be placed close to corresponding phones/speaker units. FACPs may be located at places where the various wires (communication mediums) terminate. Central station is generally placed in central places such as operations control rooms, from where it is desirable to monitor/control various components.

Continuing with the description of each component, each detector 110-A through 110-H detects a hazardous situation (or any undesirable situation for which the detector is designed) in the surrounding area, and sends an alarm if/when such a situation is detected/suspected. In general, each detector has a unique identifier based on which the specific location with the hazardous situation may be determined at an FACP. The detectors may be connected to a corresponding FACP by a loop structure (using protocols such as ARCnet, well known in the relevant arts) as shown.

The combination of phone/speaker units 150-A/150-B/150-C and audio transponder 140-A plays specific audio messages when an "on" instruction is received from control module 130-A. In addition, a user may be provided the interface to conduct a telephone call with another user at the corresponding FACP. Audio transponder 140-A may contain storage to store several pre-recorded messages, and there may be many speakers connected to it. All speakers connected to a transponder may play the same message specified by audio transponder.

Each control module 130-A through 130-D receives instructions from the corresponding FACP to turn on the connected (for example, control module 130-A is connected to audio transponder 140-A) audio transponder, and turns on the connected audio transponder in response. As noted above, turning on a transponder causes the pre-recorded voice messages to play on the phone/speaker unit connected to the audio transponder.

Fire alarm control panel (FACP) 120-A sends alarm information to central station 160 in response to receiving an alarm from a detector. In general, an FACP refers to a device at which the communication paths from various detectors terminate. FACP 120-A may activate control modules 130-A and 130-B to play the voice messages in response to receiving the appropriate alarms. Alternatively, FACP 120-A may receive instructions from central station 160 to cause the voice messages to be played, and generate the appropriate commands to the control modules.

In addition, FACP 120-A may provide an interface to enable "live messages" (i.e., operator voice in real time) to be paged/played on each of the connected phone/speaker units (i.e., 150-A, 150-B and 150-C in the case of FACP 120-A). Similarly, FACP 120-A may enable a telephone call to be setup to an operator at phone/speaker units 150-A/150-B/150-C.

Central station 160 may be provided at a central location (e.g., operation control room), and serves as a central point from which the alarms from various FACPs are received. The alarms may be monitored using an appropriate interface (e.g., GUI). An operator may be provided the ability to turn on the various control modules to cause the corresponding voice messages to be played (by interfacing via the FACPs).

Thus, using a system according to FIG. 1, various messages can be played and communication enabled to effectively deal with a (undesirable/)hazardous situation.

However, the system of FIG. 1 may have several deficiencies in terms of providing centralized control in dealing with hazards. For example, an operator may not be able to control the individual phone/speaker units to play different messages on different phone/speaker units, as desired. In addition, an operator may not have the ability to play custom messages, as suitable for specific hazardous scenario, on each of the speakers. The description is continued with respect to another conventional embodiment in which some of such disadvantages are overcome.

Figure 2:
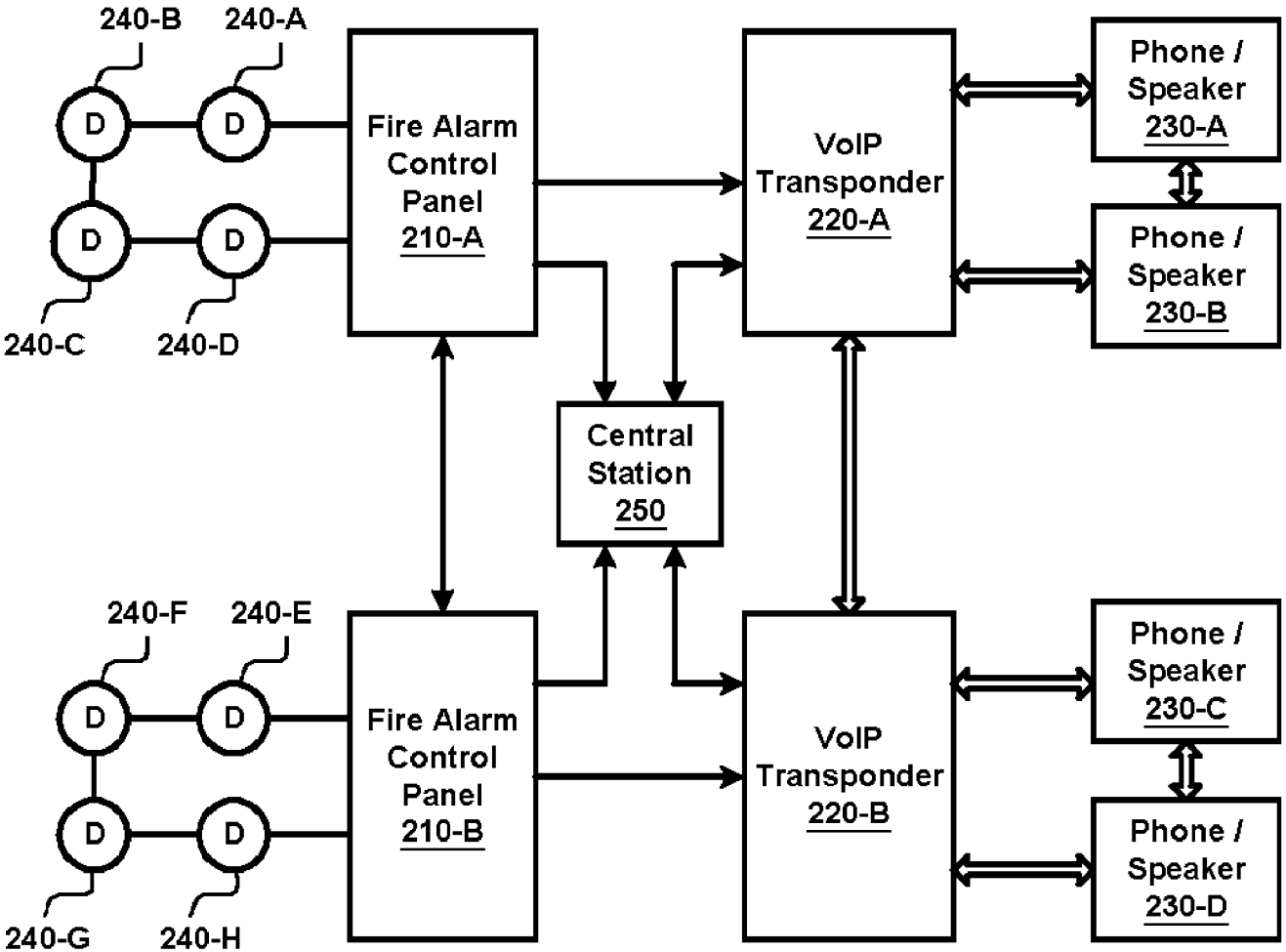
FIG. 2 (Prior Art)
FIG. 2 is a block diagram illustrating some example limitations of another conventional evacuation system implemented based on VoIP technology.

FIG. 2 is a block diagram illustrating some example limitations of another conventional evacuation system. The evacuation system is shown containing several detectors 240-A through 240-H, fire alarm control panels (FACPs) 210-A/210-B, VoIP transponders 220-A/220-B, phone/speaker units 230-A through 230-D and central station 250. For conciseness, the components of FIG. 2 are described relative to the components of FIG. 1.

Detectors 240-A through 240-H, and FACPs 210-A/210-B respectively operate similar to detectors 110-A through 110-H, and FACPs 120-A/120-B of FIG. 1. However, all of the phone/speaker units (e.g., 230-A and 230-B) connected to a VoIP transponder (220-A) play the same voice message generated by VoIP transponder.

Central station 250 may receive alarms from FACPs 210-A/210-B, and enable an operator to specify specific messages to be played on each speaker connected to a specific VoIP transponder. The voice message may be transmitted using VoIP (voice over IP) to VoIP transponder (e.g., 220-A), and VoIP transponder 220-A may cause the received message to be played on all the connected phone/speaker unit(s) 230-A and 230-B.

Thus, in comparison with the embodiment of FIG. 1, the embodiment of FIG. 2 may enable an operator to specify custom messages, which can be played on different speakers.

However, one disadvantage with such an approach is that the same message may be played on all the speakers connected to the same VoIP transponder. As a result, an operator may not have control over individual speakers (in phone/speaker units) in being able to play different messages on different speakers. In addition, it is believed that the conventional embodiments do not provide features such as volume control (from central station 250) on the speakers from a central location.

The manner in which at least some of such disadvantages may be overcome according to various features of the present invention is described below in further detail. Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, wellstructures or operations are not shown in detail to avoid obscuring the invention.

3. Overcoming Disadvantages

Figure 3:
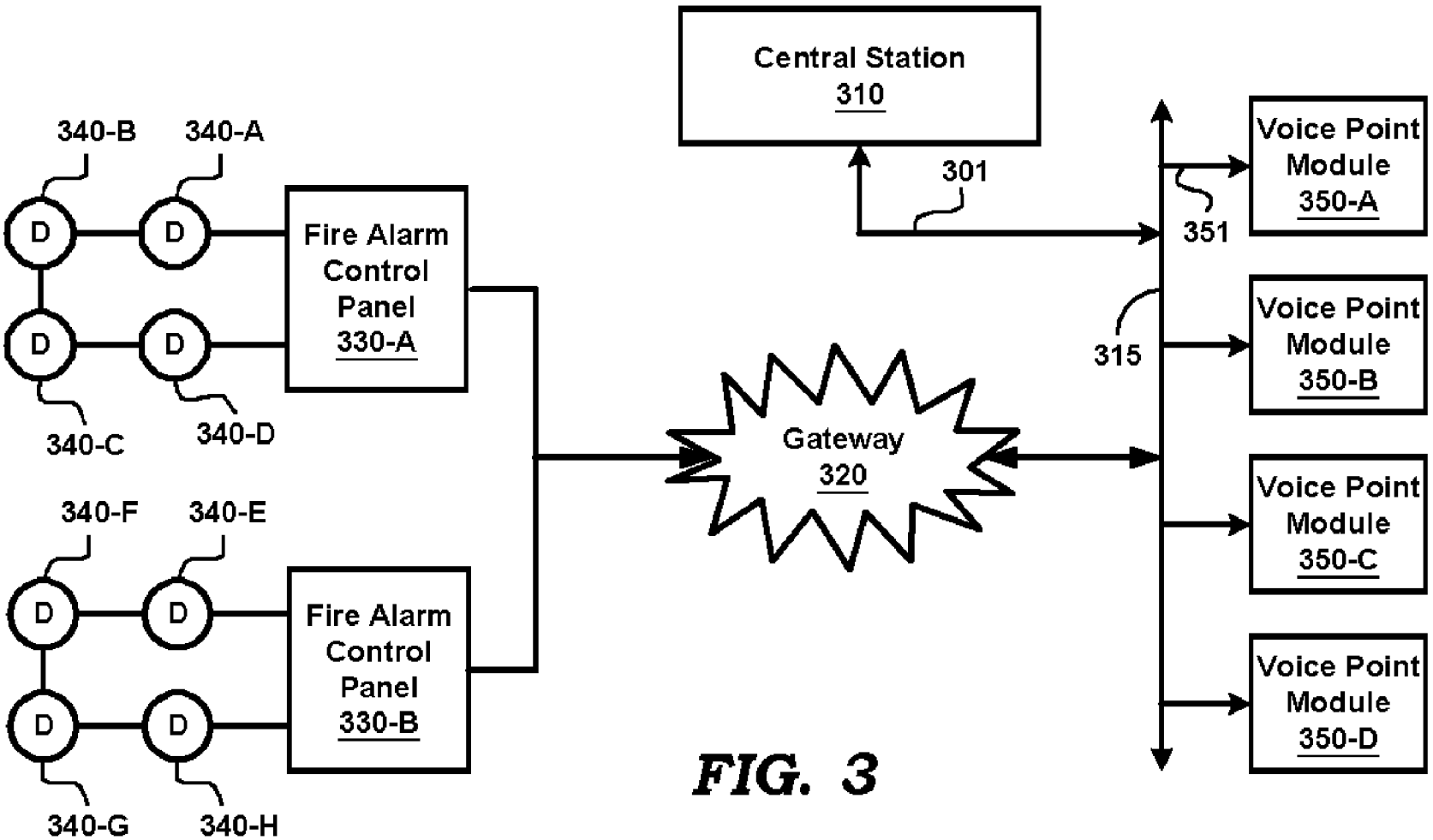
FIG. 3 is a block diagram illustrating the details of an evacuation system provided according to an aspect of the present invention.

FIG. 3 is a block diagram illustrating the details of an evacuation system provided according to an aspect of the present invention. The block diagram is shown containing central station 310, fire alarm control panels (FACP) 330-A and 330-B, gateway 320, detectors 340-A through 340-H, and voice point modules 350-A through 350-D.

Detectors 340-A through 340-H may operate similar to the detectors described with respect to FIGS. 1 and 2 above, and generate alarms when a hazardous situation is detected. FACPs 330-A and 330-B may forward the alarms to central station 310 using technologies such as IP on Ethernet.

In an embodiment, each FACP 330-A/330-B forwards the alarms to gateway 320 using ARCnet (widely available in the market place), and gateway 320 performs any necessary conversions (including generating any packet headers as suited for transmission to central station 310). The implementation of gateway 320 generally depends on the mediums and protocol on the two sides and the implementation of gateway 320 will be apparent to one skilled in the relevant arts.

Voice point modules 350-A through 350-D are all shown connected to network 315, and are individually addressable according to the network protocol used on the network. Each voice point module may be designed to operate as both a speaker and a phone.

In an embodiment, each voice point module is addressable using a corresponding IP (Internet Protocol) address. Each voice point module receives a voice message ("live message") to be played using VoIP, and plays the corresponding message. Each voice point module may further receive control messages, which indicate operations such as increasing the volume, playing a pre-stored message, etc. An embodiment of voice point module is described in a section below in further detail.

Central station 310 may receive various alarms from FACP 330-A/330-B, and provide a suitable interface for an operator to see the corresponding information. In addition, central station 310 may enable an operator to specify custom messages (either pre-stored or by capturing live voice) to be played on each voice point module.

As each voice point module is individually addressable, different messages may be sent to different voice point modules. In addition, an operator may dynamically (in real-time or impromptu) generate messages, which are immediately played on the voice point modules of interest. As a result, an operator may have enhanced operational control during evacuation. The description is continued with reference to the details of example embodiments of a voice point module and a central station.

4. Voice Point Module

Figure 4:
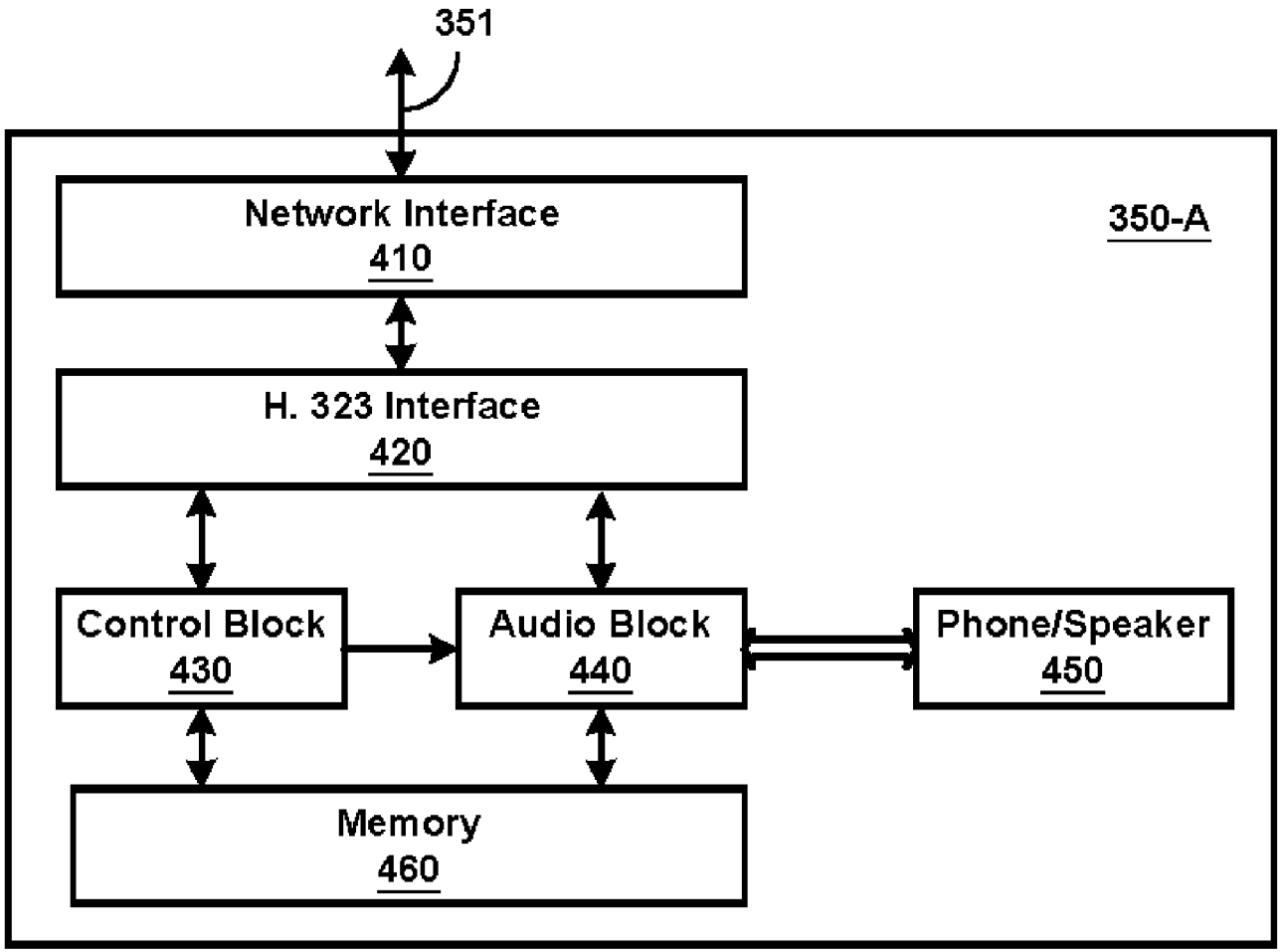
FIG. 4 is a block diagram illustrating the details of a voice point module provided according to an aspect of the present invention.

FIG. 4 is a block diagram illustrating the details of voice point module 350-A in an embodiment of the present invention. Voice point module 350-A is shown containing network interface 410, H.323 interface 420, control Block 430, audio block 440, phone/speaker unit 450 and memory 460. Merely for conciseness, the description is provided with respect to voice point module 350-A, however, the description is applicable to other voice point modules 350-B through 350-D as well.

Network interface 410 receives IP packets on path 351 (connected to network 315), and forwards the payload of the appropriate packets to H.323 interface. In general, network interfaces are configured with an IP address, and only packets with a destination address of the IP address (and other appropriate multicasts) are forwarded to H.323 interface 420. Due to such addressing approaches, voice point module 350-A (and thus the voice generators) would be individually addressable according to an aspect of the present invention.

H.323 interface 420 parses the payload according to H.323 protocol (an ITU standard, well known in the relevant arts) to split the received data into control data and voice data. The control data is passed to control block 430, and voice data is passed to audio block 440. Control data generally provides control instructions such as volume control (to increase or decrease the volume), indicating the manner in which the voice data is to be processed (e.g., play the message live or store the message in memory 460), or to play a specific message stored in memory 460. Voice data may represent the voice messages to be played live or stored in memory 460.

Memory 460 provides storage for storing various types of data. For example, any of the 'standard/repetitive' messages may be stored in memory 460 (e.g., in an indexed form), and the messages may be selectively played by appropriate control instructions. Memory 460 may also store various parameters, which control audio characteristics such as volume level and pitch, and the parameters may then be used in playing messages on phone/speaker unit 450. In addition, memory 460 may store any identification data (e.g., building/room name/location) provided using a suitable interface (e.g., serial interface, not shown).

Phone/speaker unit 450 plays voice messages under the control of audio block 440. In addition, phone/speaker unit 450 may enable a user to conduct a telephone call with an operator of central station 310 or users at other voice point modules. Analog signal representing the user's voice may be converted into digital format by audio block 440. Phone/speaker unit 450 may be provided external to voice point module 350-A.

Audio block 440 operates under the control of control block 440, and determines the manner in which to process voice data. For example, audio block 440 may play presently received voice messages from H.323 interface 420 or messages pre-stored in memory 460 as specified by control block 430. In addition, presently received voice messages may be stored in memory 460, if so specified by control block 430. While playing messages, the audio characteristics may be controlled by various parameters stored in memory 460.

Audio block 440 may receive data representing voice (generated by a user of voice point module 350-A) from phone/speaker unit 450, and interface with H.323 interface 420 to forward the data to an appropriate block (e.g., central station 310 or another voice point module). Audio block 440 generally needs to be implemented consistent with phone/speaker unit 450, and may be implemented in a known way.

Control block 430 receives control data, and controls the operation of audio block 440 according to the instructions represented by the control data. For example, a control instruction may specify that a specific message stored in memory 460 is to be played, in which case the message is retrieved from memory 460 and the corresponding data is provided to audio block 440 for playing on phone/speaker unit 450. Another control instruction may specify that voice data presently being received is to be stored in memory 460, in which case the voice data is stored in memory 460 by appropriate interface with audio block 440.

Yet another instruction may specify that the volume of phone/speaker unit 450 is to be altered/changed, in which case the corresponding parameter (controlling volume) may be stored in memory 460. The parameter may immediately alter the volume of messages played on phone/speaker unit 450. One more instruction may request a call to be connected at phone/speaker unit 450, in which case a connection may be established (by H.323 interface 420 according to H.323 protocol) for the user at phone/speaker unit 450. Due to the use of H.323 and VoIP, point-to-point calls or teleconference calls may be established with other users/operators.

If the instruction indicates that a presently being received voice data is to be played as a 'live message', audio block 440 is controlled to play the voice message on phone/speaker unit 450. Another instruction may request an identification data for voice point module 350-A to be sent back as a response. The identification data may be provided by a user using an interface such as a serial interface (not shown), and stored in memory 460. Accordingly, control block 430 retrieves the identification data from memory 460, and generates a response. The control data and responses may be encoded according to any pre-specified protocol, the implementation of which will be apparent to one skilled in the relevant arts.

Control block 430 may send the identification data voluntarily (without request from central station 310), for example, in the form of a broadcast at the time of initialization of voice point module 350-A. The data may be received by central station 310 to provide, what is commonly known as an 'auto-discovery feature'. Central station 310 may display a map containing all the discovered devices using a suitable user interface, and further control of individual voice point devices may be facilitated.

From the above, it may be appreciated that due to the addressability of each voice point module individually, an operator at central station 310 may have substantially more control over the evacuation procedures at least since custom/specific messages may be played at each voice point module. In addition, due to the presence of parallel control and data channels provided by H.323 protocol, various features (such as altering volume levels) may be provided as well. Also, features such as teleconference may be provided due to the use of the combination of H.323 and VoIP.

In addition, due to accessibility of voice point modules on a network, central station may control voice point modules directly (compared to via the FACPs in the prior art). The description is continued with respect to the details of an embodiment of central station 310.

5. Central Station

Figure 5:
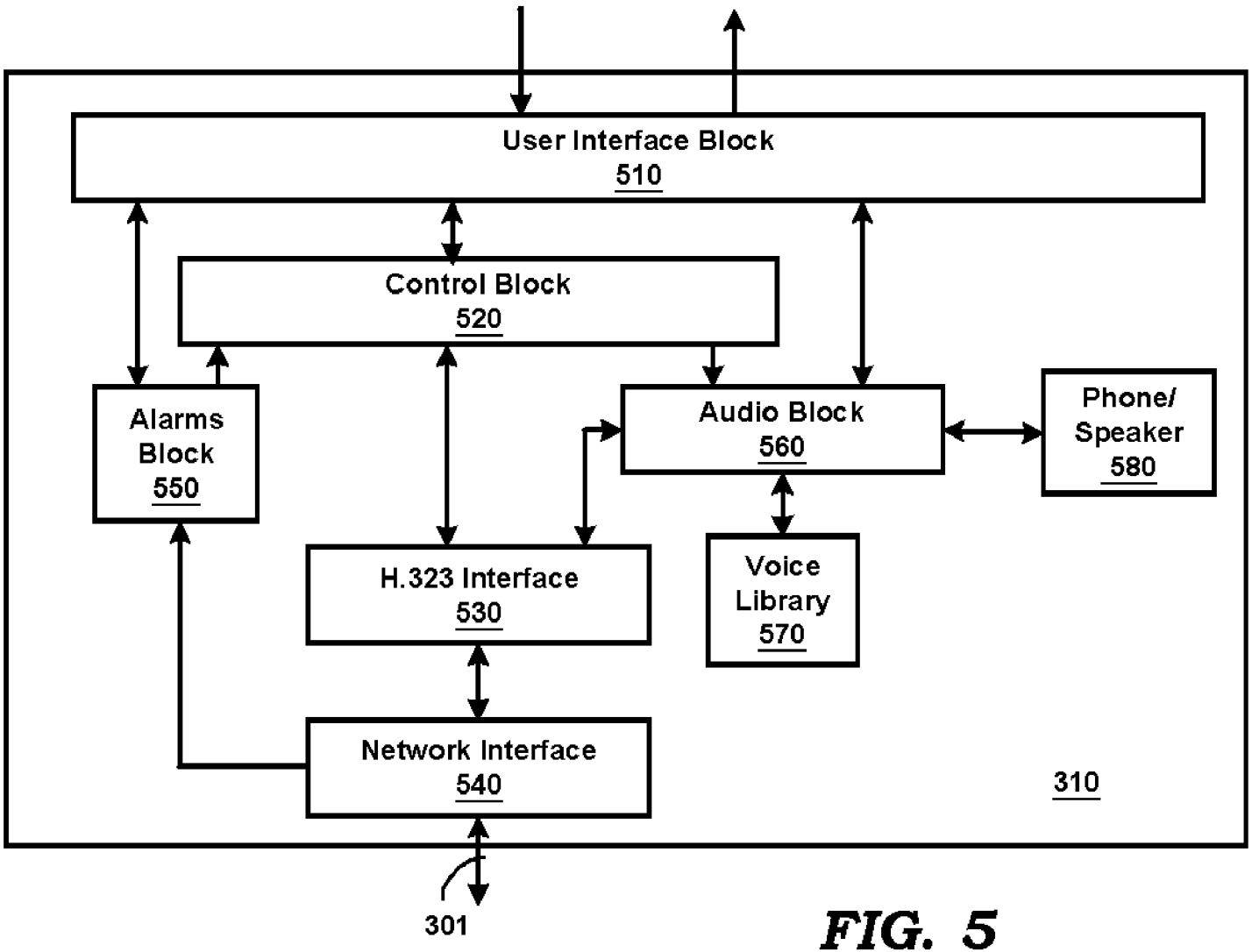
FIG. 5 is a block diagram illustrating the details of a central station provided according to an aspect of the present invention.

FIG. 5 is a block diagram illustrating the details of central station 310 in an embodiment of the present invention. Central station 310 is shown containing user interface block 510, control block 520, H.323 interface 530, network interface 540, alarms block 550, audio block 560, voice library 570 and phone/speaker unit 580. Each component is described in detail below.

Network interface 540 receives IP packets on path 301 (connected to network 315, not shown), and forwards the payload of the appropriate packets to H.323 interface 530. Payloads of packets with alarm information are forwarded to alarms block 550. In general, the packet header is parsed to determine the specific block to which to forward the payload. Network interface 540 may receive payload forwarding as IP packets, and the header information is appended before forwarding the resulting IP packets on path 301.

H.323 interface 530 packages the control data and voice data according to H.323 protocol and passes the resulting payload to network interface 540. The control data may be received from control block 520, and voice data from audio block 560. As noted above, control data generally provides control instructions such as volume control (to increase or decrease the volume), indicating the manner in which the voice data is to be processed (e.g., play the message live), or to play a specific message stored in memory. Voice data may represent the live voice messages or any message stored in voice library 570.

Alarms block 550 may receive alarm information from FACPs 330-A and 330-B through path 301, and process the alarms to determine an appropriate action suitable for each alarm. For example, if a received alarm indicates the occurrence/presence of a hazardous situation, alarms block 550 may determine the specific messages to be played on each phone/speaker location, and indicates the corresponding action to control block 520. Alarms block 550 may be programmed to ignore (or simply log) some of the low priority alarms (which may be designed for information-only), and to merely forward some other of the alarms directly to user interface block 510. In general, when forwarding alarm information, alarms block 550 may forward to control block 520 the source (or the detector/FACP) from which the alarm is received.

Voice library 570 stores a set of messages, which may be quickly selected by an operator (or control block 520) and played on voice point module(s) of interest. A potentially large memory may be employed (for voice library) to store many messages of interest. It may be appreciated that the overall cost of implementation is not substantially enhanced since such large number of messages need to be stored only at a central place (and not at individual voice point modules). Phone/speaker unit 580 may be used by an operator either to conduct a telephone call with users at voice point module, or to play live messages (i.e., whatever the operator speaks at central station 310 is played on the voice point module(s)).

Audio block 560 receives voice data from H.323 interface 530, and plays the corresponding voice by controlling phone/speaker unit 580, which enables an operator at central station 310 to conduct a telephone call with users at FACPs or voice point modules. Audio block 560 selects one of the messages available in voice library 570 under the control of control block 520, and forwards the corresponding data to H.323 interface.

User interface block 510 provides a convenient interface for a user to control evacuation in case of detection of a hazardous situation. For example, a map of the entire location/building may be logically displayed, and the detectors/FACPs and voice point modules may be placed at the corresponding locations. Alarms may be displayed (with color coding for different types of alarms) associated with each detector/FACP.

Based on the location of the detectors with alarms, an operator may specify custom messages to be played on each voice point module. The messages may be pre-stored at the individual voice point modules, selected from voice library or received live (as an operator speaks). Due to the individual addressability of the voice point modules, custom messages may be played on individual voice point modules.

Control block 520 coordinates and controls the operation of other blocks of central station 310. When an operator wishes to play a message on a selected one of the voice point modules, control block 520 controls H.323 interface 530 to send IP packets consistent with the H.323 protocol. The destination address of the IP packets depends on the voice point module to which the packets are to be forwarded, and may be determined in a known way. Control block 520 may further perform any default actions (e.g., playing a pre-stored message if operator intervention is not noticed in a reasonable time after detection of a hazardous situation) in response to receiving some type of alarms.

Thus, using approaches such as above, it may be appreciated that more control may be provided to an operator of a central station. The description is continued with respect to an embodiment of central station 310, implemented substantially in the form of software instructions.

6. Software Implementation

Figure 6:
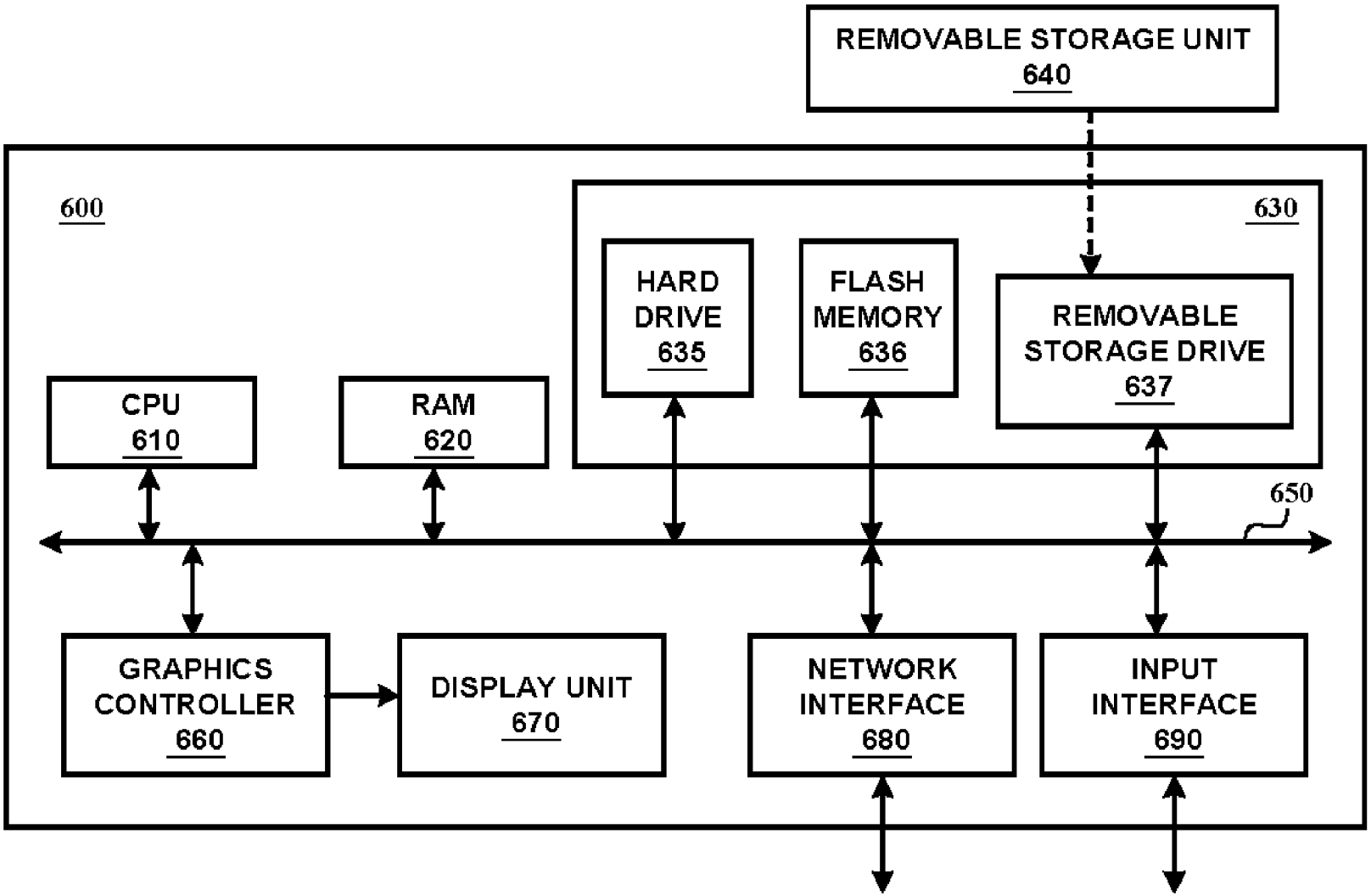
FIG. 6 is a block diagram illustrating the details of a central station which is controlled by software instructions to provide several features of the present invention.

FIG. 6 is a block diagram illustrating the details of central station 310 in one embodiment. Central station 310 may contain one or more processors such as central processing unit (CPU) 610, random access memory (RAM) 620, secondary memory 630, graphics controller 660, display unit 670, network interface 680, and input interface 690. All the components except display unit 670 may communicate with each other over communication path 650, which may contain several buses as is well known in the relevant arts. The components of FIG. 6 are described below in further detail.

CPU 610 may execute instructions stored in RAM 620 to provide several features of the present invention. CPU 610 may contain multiple processing units, with each processing unit potentially being designed for a specific task. Alternatively, CPU 610 may contain only a single general purpose processing unit.

RAM 620 may receive instructions from secondary memory 630 using communication path 650. The instructions may implement one or more of the various user applications, access module, procedures, etc., described above.

Graphics controller 660 generates display signals (e.g., in RGB format) to display unit 670 based on data/instructions received from CPU 610. Display unit 670 contains a display screen to display the images defined by the display signals. Input interface 690 may correspond to a keyboard and/or mouse. Graphics controller 660, display unit 670, and input interface 690 together provide a suitable user interface using which an operator may control evacuation procedures using different features provided by various aspects of the present invention.

Secondary memory 630 may contain hard drive 635, flash memory 636 and removable storage drive 637. Secondary memory 630 may store the data and software instructions, which enable central station 310 to provide several features in accordance with the present invention. Some or all of the data and instructions may be provided on removable storage unit 640, and the data and instructions may be read and provided by removable storage drive 637 to CPU 610. Floppy drive, magnetic tape drive, CD_ROM drive, DVD Drive, Flash memory, removable memory chip (PCMCIA Card, EPROM) are examples of such removable storage drive 637.

Removable storage unit 640 may be implemented using medium and storage format compatible with removable storage drive 637 such that removable storage drive 637 can read the data and instructions. Thus, removable storage unit 640 includes a computer readable storage medium having stored therein computer software and/or data.

In this document, the term "computer program product" is used to generally refer to removable storage unit 640 or hard disk installed in hard drive 635. These computer program products are means for providing software to central station 310. CPU 610 may retrieve the software instructions, and execute the instructions to provide various features of the present invention as described above.

7. Conclusion

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

The invention claimed is:

1. An evacuation system comprising:

a plurality of detectors, each of said plurality of detectors being designed to detect an undesirable situation at a corresponding location and to generate an alarm in response to detecting said undesirable situation;

a plurality of voice point modules, wherein each of said plurality of voice point modules is addressable by a corresponding address and is capable of playing voice messages; and a station being designed to receive said alarm, and to cause a potentially different message to be played on one or more of said plurality of voice point modules, whereby an operator using said station has enhanced control over evacuation.

2. An evacuation system comprising:

a plurality of detectors, each of said plurality of detectors being designed to detect an undesirable situation at a corresponding location and to generate an alarm in response to detecting said undesirable situation;

a plurality of voice point modules, wherein each of said plurality of voice point modules is individually addressable and is capable of playing voice messages;

a station being designed to receive said alarm, and to cause a potentially different message to be played on each of said plurality of voice point modules, whereby an operator using said station has enhanced control over evacuation;

a fire alarm control panel (FACP) being positioned between said station and said plurality of detectors, said FACP receiving said alarm from each of said plurality of detectors, and forwarding said alarms to said station, wherein said station sends packets directly to said plurality of voice point modules without said FACP being in the path from said station to said plurality of detectors.

3. The evacuation system of claim 2, wherein said station communicates with said plurality of voice point modules over a network, wherein each of said plurality of voice modules is individually addressable by an addressing approach specified by said network.

4. The evacuation system of claim 3, wherein said network is implemented using Internet Protocol (IP), wherein each of said plurality of voice point modules is addressed by at least one IP address.

5. The evacuation system of claim 3, wherein said station enables said operator to speak and provide corresponding voice as a live message, wherein said station converts said live message as a voice data and forwards said voice data to one or more of said plurality of voice point modules as said live message.

6. The evacuation system of claim 5, wherein said station sends a control data to each of said plurality of voice point modules on a control connection.

7. The evacuation system of claim 6, wherein said control data indicates that said voice data is to be played as said live message.

8. The evacuation system of claim 7, wherein said control data and said live message are sent according to H.323 protocol.

9. The evacuation system of claim 7, wherein said station sends a second voice data to a second voice point module comprised in said plurality of voice point modules, wherein said control data requests to store said voice data in said second voice point module, said second voice point module comprising:

a memory storing a plurality of messages; and a control block causing said voice data to be stored in said memory in response to said request.

10. The evacuation system of claim 9, wherein said station sends a third control data requesting said second voice point module to play one of said plurality of messages, said second voice point module further comprising:

a voice module receiving said one of said plurality of messages from said memory and playing said one of said plurality of messages on a speaker.

11. The evacuation system of claim 10, wherein said station sends a fourth control data requesting a volume of said speaker to be changed, wherein said volume of said speaker is changed in response to said fourth control data being received in said second voice point module.

12. The evacuation system of claim 9, wherein said station sends a fifth control data requesting a telephone call be setup at said second voice point module, wherein said control block sets up said telephone call using a phone in response to receiving said fifth control data.

13. A voice point module comprising:

a network interface having an address such that said voice point module is addressable by said address;

an audio block receiving a voice data; and a control block receiving a control data and causing said voice data to be processed according to said control data, wherein said network interface receives said voice data and said control data in one or more packets, and forwards said voice data to said audio block and said control data to said control block if said one or more packets have a destination address equaling said address.

14. The voice point module of claim 13, wherein said control data specifies that said voice data is to be played as a live message, wherein said control block causes said audio block to play said voice data as said live message on a speaker in response to receiving said control data.

15. The voice point module of claim 13, further comprising a memory, wherein said control data specifies that said voice data is to be stored in said memory as a message, wherein said control block causes said voice data to be stored in said memory in response to receiving said control data.

16. The voice point module of claim 15, wherein said control block receives another control data, wherein said another control data requests that said message stored in said memory be played immediately, wherein said control block causes said audio block to play said message on a speaker in response to receiving said another control data.

17. The voice point module of claim 13, wherein said control data specifies a volume level of a speaker is to be changed, wherein said control block causes said audio block to change said volume level of said speaker in response to receiving said control data.

18. The voice point module of claim 13, wherein said control data specifies that a telephone call be setup with a phone provided with said voice point module, wherein said control block causes said telephone call to be setup in response to receiving said control data.

19. A computer readable medium carrying one or more sequences of instructions for causing a station to provide increased operational control over evacuation procedures when an undesirable situation is detected, said station being connected to a network, wherein execution of said one or more sequences of instructions by one or more processors causes said one or more processors to perform the actions of:

receiving on said network a packet containing an alarm, said alarm indicating the detection of said undesirable situation; and sending a voice data and a control data in the form of a plurality of packets in response to said receiving, wherein each of said plurality of packets contains an address of a voice point module, wherein said voice point module is accessible by said address, wherein said voice point module processes said voice data according to said control data.

20. The computer readable medium of claim 19, wherein said control data specifies that said voice data is to be played as a live message, wherein said voice point module plays said voice data as said live message on a speaker in response to receiving said control data.

21. The computer readable medium of claim 19, wherein said control data specifies that said voice data is to be stored in said voice point module as a message, wherein said voice point module stores said voice data in a memory in response to receiving said control data.

22. The computer readable medium of claim 21, further comprising sending another control data to said voice point module, wherein said another control data requests that said message stored in said memory be played immediately, wherein said voice point module plays said message on a speaker in response to receiving said another control data.

23. The computer readable medium of claim 19, wherein said control data specifies a volume level of a speaker is to be changed, wherein said voice point module causes said volume level of said speaker to be changed in response to receiving said control data.

24. The evacuation system of claim 1, wherein said station communicates with said one or more of said plurality of voice modules using said corresponding address of each of said one or more of said plurality of voice modules , and said playing of voice messages occurring in response to receiving said communication from said station, wherein said communication specifies which one of said voice messages is to be played.

25. The evacuation system of claim 1, wherein each of said voice point modules sends said corresponding address to said station at a time of initialization, and said station displays a map of all voice point modules from which the corresponding address is received.

* * * * *